US005259551A

United States Patent [19]

Davis

[11] Patent Number: 5,259,551

[45] Date of Patent: Nov. 9, 1993

[54] DISPLAY CARTON AND METHOD OF MAKING SAME

[75] Inventor: Wiley D. Davis, Chattanooga, Tenn.

[73] Assignee: Textile Printing Company, Chattanooga, Tenn.

[21] Appl. No.: 47,195

[22] Filed: Apr. 16, 1993

[51] Int. Cl.[5] ..... B65D 5/42

[52] U.S. Cl. ..... 229/162; 206/45.31; 493/114; 493/128

[58] Field of Search ..... 229/162; 206/45.31, 206/45.34; 493/84, 114, 128, 905

[56] References Cited

U.S. PATENT DOCUMENTS

| | | | |
|---|---|---|---|
| 2,924,371 | 6/1951 | Frankenstein | 206/45.31 |
| 3,301,143 | 1/1967 | Palmer | 229/162 |
| 3,409,445 | 11/1968 | Hall | 229/162 |
| 3,533,546 | 4/1968 | Kossnar | 206/831 |
| 3,635,393 | 1/1972 | Herglotz | 229/162 |
| 3,835,988 | 9/1974 | Buttery | 229/162 |
| 3,870,221 | 3/1975 | Zeitter | 206/45.31 |
| 4,664,648 | 5/1987 | Dupuy | 206/45.31 |
| 4,733,916 | 3/1988 | Seufert | 229/162 |
| 4,821,951 | 4/1989 | Franzoni | 229/162 |
| 4,826,004 | 5/1989 | Dupuy | 206/45.34 |
| 4,846,775 | 7/1989 | Herrin | 493/95 |
| 4,858,756 | 8/1989 | Herrin et al. | 206/45.34 |
| 5,160,083 | 11/1992 | Lafreniere | 229/162 |

*Primary Examiner*—Gary E. Elkins
*Attorney, Agent, or Firm*—Brady, O'Boyle & Gates

[57] ABSTRACT

A display carton having a corner window wherein the adhesive for securing the overlapping panels forming a window aperture in the side walls of a carton is also employed for securing a portion of a window in the aperture. One of the overlapping panels is cut to form a notch dimensioned to correspond with the other overlapped panel so that when the panels are folded in face-to-face relationship a portion of the window frame is formed.

10 Claims, 5 Drawing Sheets

DISPLAY CARTON AND METHOD OF MAKING SAME

BACKGROUND OF THE INVENTION

Various display cartons have been proposed wherein a cardboard blank is scored and cut to provide a plurality of hingedly connected panels one of which has a window aperture formed therein over which a window of transparent semi-rigid, synthetic, plastic sheet material is secured by adhesive applied to the peripheral portion of the blank or frame around the window aperture upon which the marginal portions of the plastic window overlap.

Many cartons of this kind are known wherein the window is provided in a wall of the carton, whereby the contents of the carton are displayed. These cartons posted no problems when the blank panels were folded and adhesively secured together in the erected position.

In display cartons having windows extending between adjacent walls, such as the corner window constructions shown in the display boxes disclosed in U.S. Pat. Nos. 3,301,143; 4,664,648; and 4,846,775, the adhesively securing of the window and the subsequent folding of the panels and associated window resulted in the semi-rigid plastic window becoming distorted or fractured due to its confinement by the window frame during the folding of the blank. To overcome this problem, the semi-rigid plastic window was pre-scored to form a fold line, or certain marginal portions of the plastic window were free of adhesive to thereby permit relative slippage between the window and frame, whereby excess material of the window at the fold line is free from confinement by the window frame.

The display carton of the present invention is an improvement over the prior art corner window display cartons in that the cardboard blank and associated semi-rigid, synthetic, plastic window of the present invention are constructed and arranged to permit slippage of the window during the folding of the blank, but subsequent bonding of the initially adhesive-free marginal portion of the window to the window frame by using a portion of the adhesive employed for securing overlapping panels forming a side wall of the carton when erected.

SUMMARY OF THE INVENTION

The display carton of the present invention comprises, essentially, a cardboard blank scored and cut to provide a plurality of hingedly connected panels having a rectangular window aperture extending between a pair of adjacent panels. A rectangular substantially rigid synthetic plastic window is adhesively secured along three sides of the portion of the window frame contained in one of the pair of adjacent panels. The portion of the plastic window extending along three sides of the portion of the window frame in the other panel of said pair of adjacent panels being free of adhesive, whereby that portion of the window is slidable on the other panel during the folding of the blank.

One of the blank panels is cut to form a notch, dimensioned to correspond to the portion of the window frame of the other panel of said pair of adjacent panels so that when the blank is folded, the notched panel is placed in aligned, face-to-face relationship with the other panel of said pair of adjacent panels to thereby form a portion of the window aperture frame.

An adhesive for securing the notched panel to the other panel is deposited on top of the plastic window on three sides thereof and overlapping the window and adjacent portions of the other panel of said pair of adjacent panels, whereby during the folding of the blank to form a carton, the sliding movement of the marginal portion of the substantially rigid window relative to the adjacent portion of the other panel of the pair, results in a portion of the adhesive on the adjacent portion of the other panel extending underneath the marginal portion of the window. By this construction and arrangement, the adhesive employed for securing the over-lapping panels forming a windowed side wall of the carton when erected, is also employed for bonding the initially adhesive free marginal portion of the window to the window frame.

DESCRIPTION OF THE PREFERRED EMBODIMENT

Figure 1:
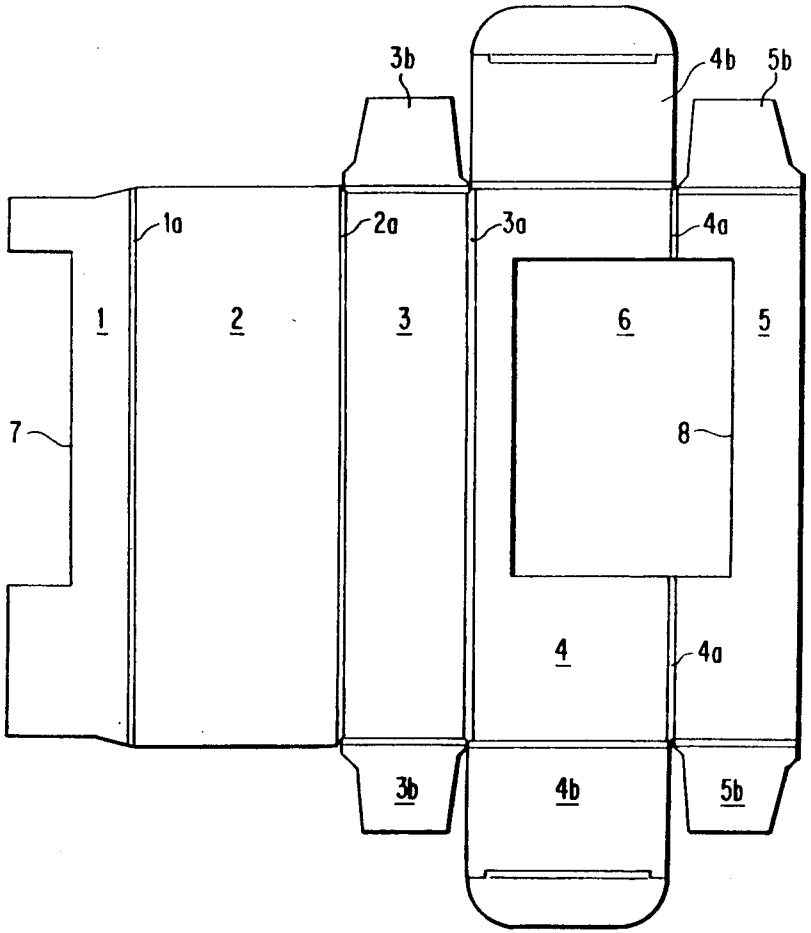
FIG. 1 is a top plan view of a blank scored and cut to provide a plurality of hingedly connected panels having a rectangular window aperture extending between a pair of adjacent panels.

Referring to the drawings in greater detail, and more particularly to FIG. 1, a cardboard blank is cut and scored to provide a plurality of panels 1, 2, 3, 4 and 5 consecutively hingedly connected together as at 1*a*, 2*a*, 5*a* and 4*a*. Panels 3, 4 and 5 have hinged flaps 3*b*, 4*b* and 5*b*, respectively, and a rectangular window aperture 6 is cut in the blank and extends between adjacent panels 4 and 5. The panel 1 is cut to form a notch 7 in the terminal edge thereof, dimensioned to correspond to a similarly notched portion 8 provided in panel 5, so that when the blank is folded to form a display carton, to be described more fully hereinafter, the notched panel 1 is placed in aligned face-to-face relationship with notched panel 5, to thereby form a portion of the frame surrounding the window.

Figure 2:
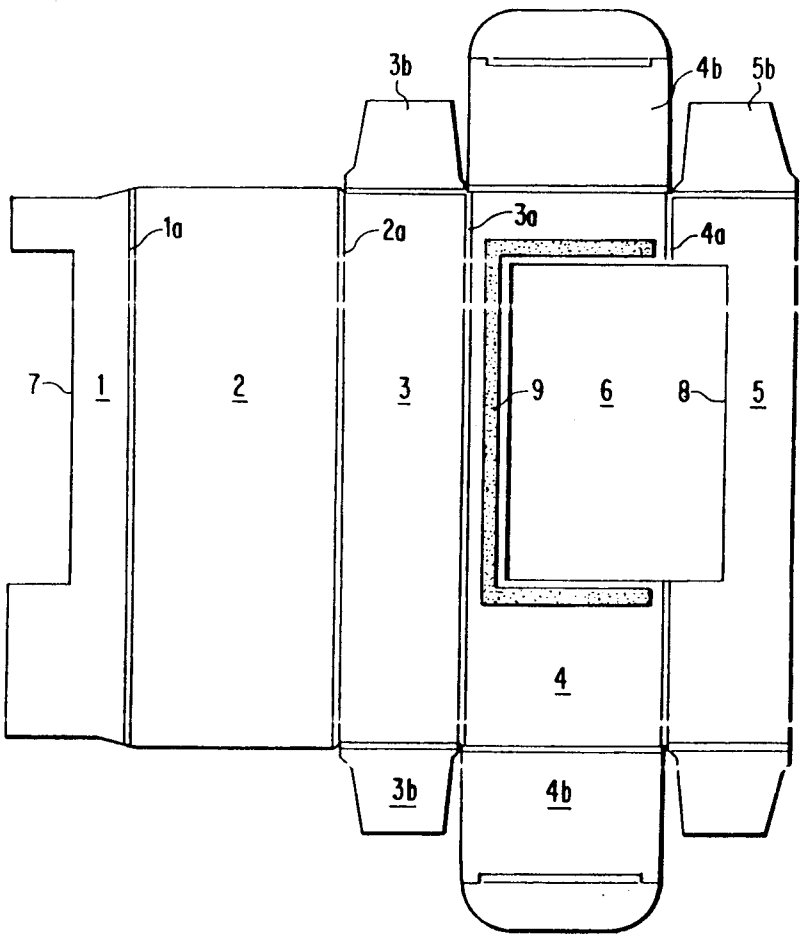
FIG. 2 is a top plan view of the blank illustrated in FIG. 1 showing adhesive applied on three sides of the portion of the window frame contained in one of the pair of adjacent panels.
Figure 2A:
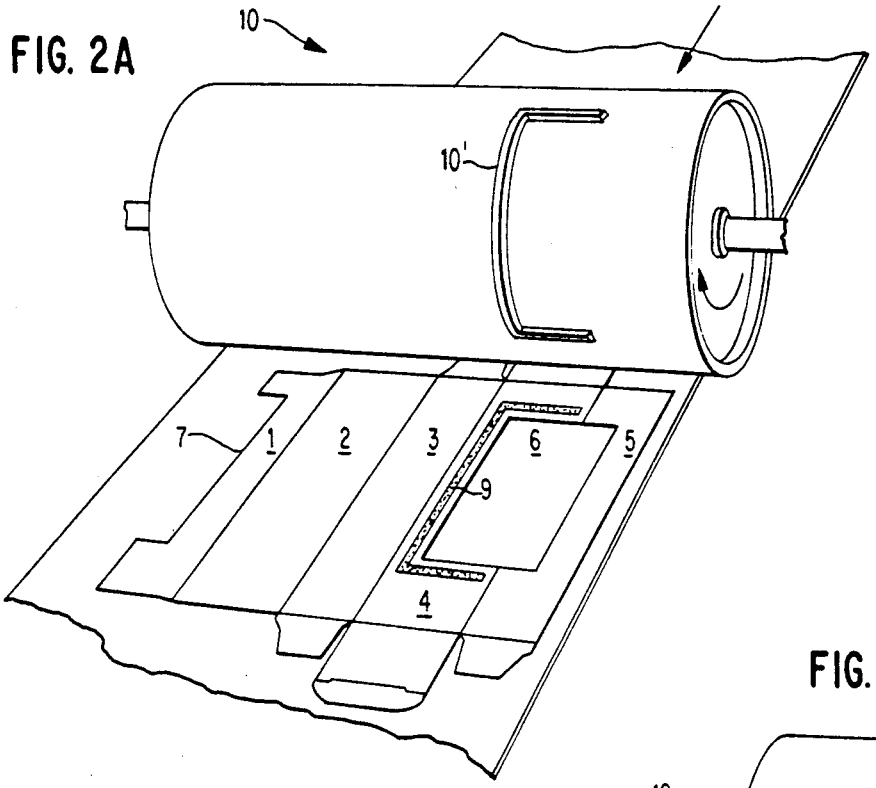
FIG. 2A is a fragmentary, perspective view of the apparatus for applying the adhesive shown in FIG. 2.

As will be seen in FIG. 2, a strip of adhesive 9 is applied to the panel 4 around three side portions of the window aperture 6, the strip of adhesive 9 being applied to the blank by conveying the blank under a rotating adhesive applicator 10, having an adhesive applying die 10' thereon, as shown in FIG. 2A.

Figure 3:
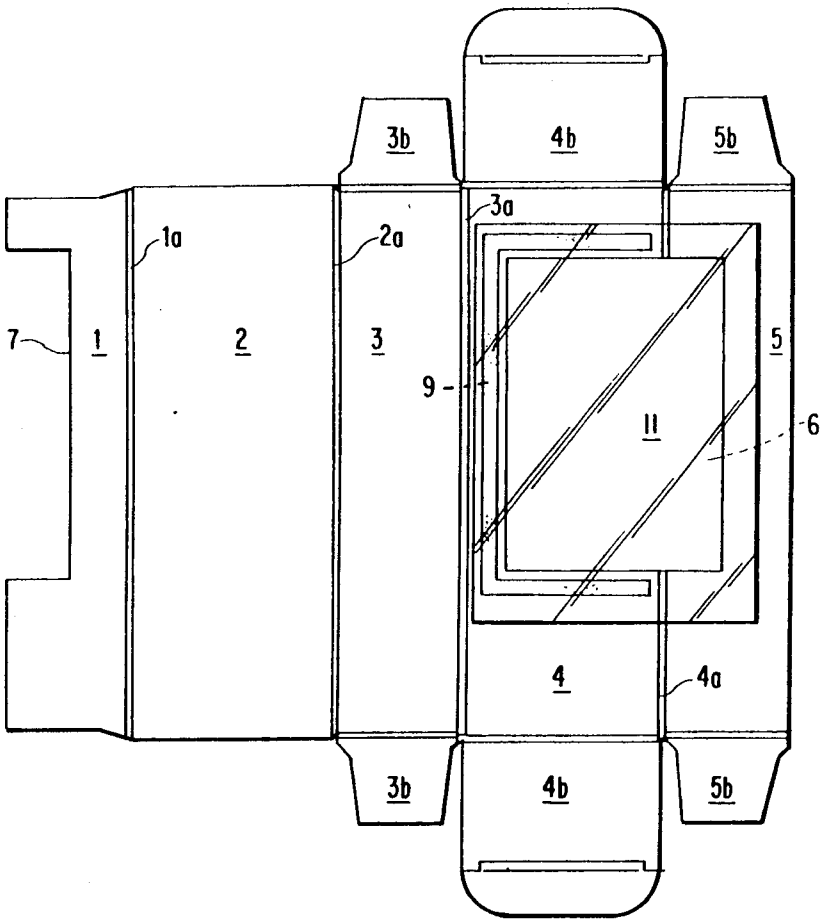
FIG. 3 is a top plan view of the blank illustrated in FIG. 2 showing a rigid synthetic plastic window placed over the window aperture.

As will be seen in FIG. 3, a transparent, rectangular, substantially rigid, synthetic plastic window 11 is placed on top of and in registration with the window aperture 6 and extends over the adjacent peripheral portions on the frame of the window aperture 6. The portion of the window 11 which extends over the panel 4 is secured to the window aperture frame portion in panel 4, on three sides, by the adhesive 9; while the portion of the window 11 which extends over the window frame portion, or notched portion 8, in panel 5 is free of adhesive.

Figure 4A:
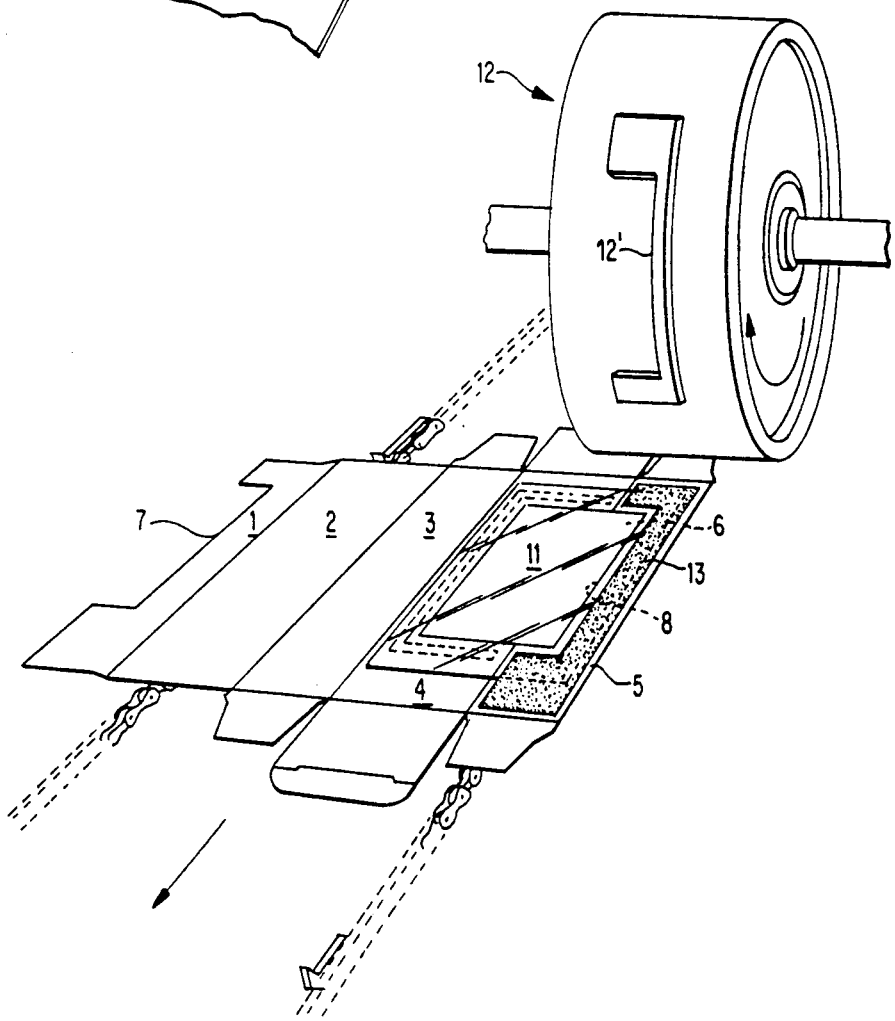
FIG. 4A is a fragmentary perspective view of the apparatus for applying the adhesive shown in FIG. 4.
Figure 4:
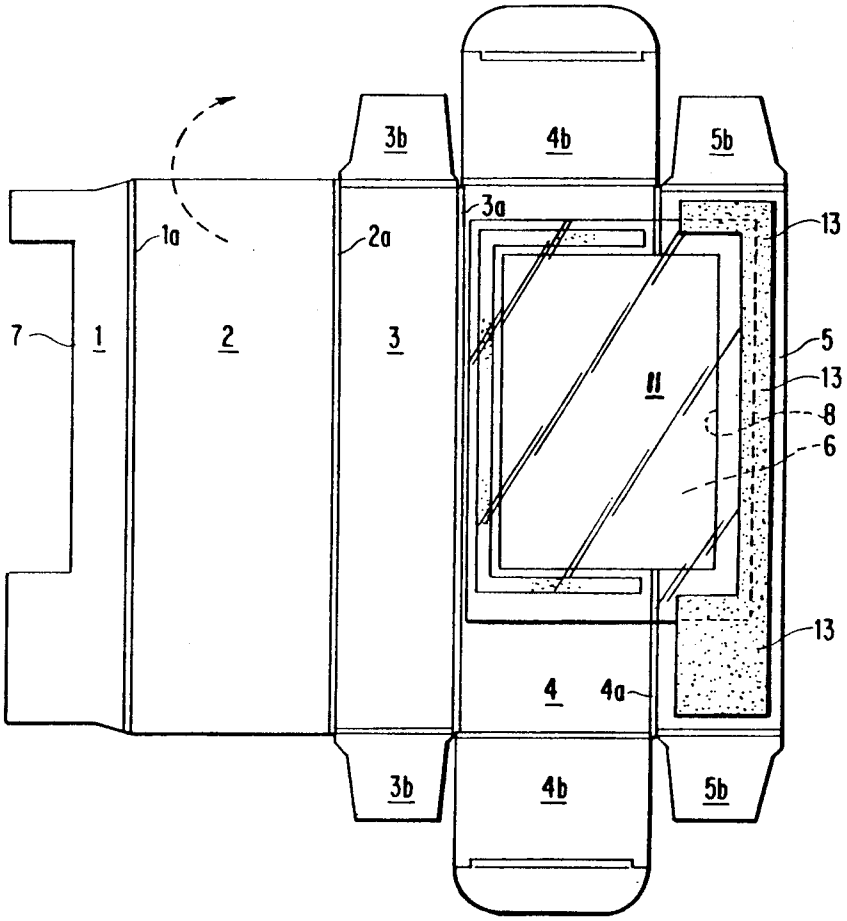
FIG. 4 is a top plan view of the blank illustrated in FIG. 3 showing the adhesive deposited on the top of the window on three sides thereof and overlapping the window and adjacent portions of the other panel of said pair of adjacent panels.

The blank and associated window 11 are further conveyed downstream from the first adhesive applicator 10 to a second rotating adhesive applicator 12, as shown in FIG. 4A, where a strip of adhesive 13 is applied by die portion 12' thereon to the top surface portion of the window 11 extending around three sides of notched portion 8 of the window aperture 6 and overlapping the adjacent frame portion of the window 11 on the surface of panel 5 on three sides, as shown in FIG. 4.

Figure 6:
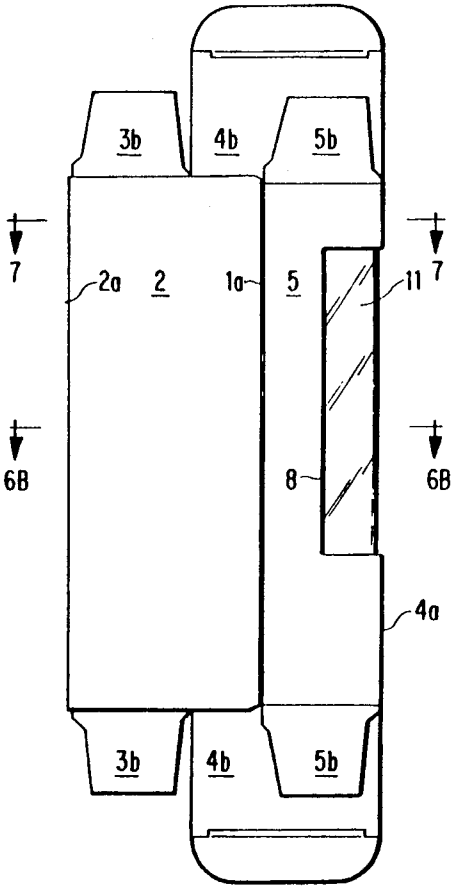
FIG. 6 is a side elevational view of the blank folded and the panels forming the apertured side wall being adhesively secured together.
Figure 5:
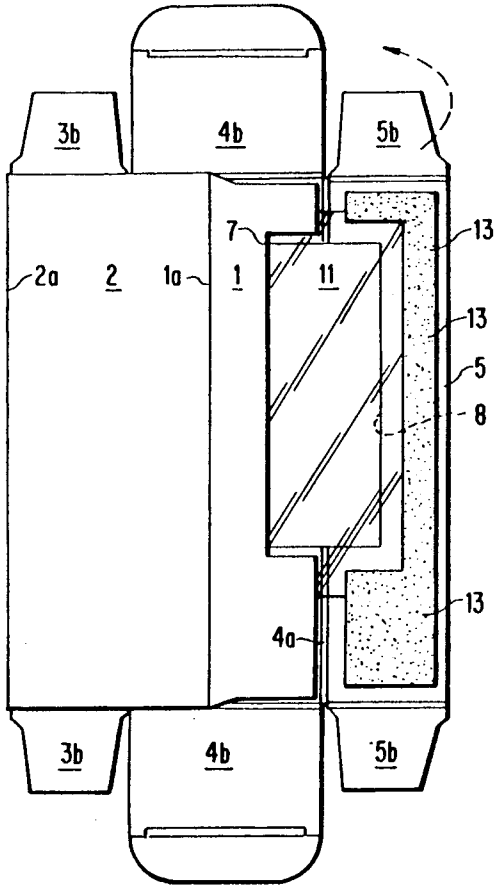
FIG. 5 is a top plan view of the blank folded to an initial position.
Figure 5A:
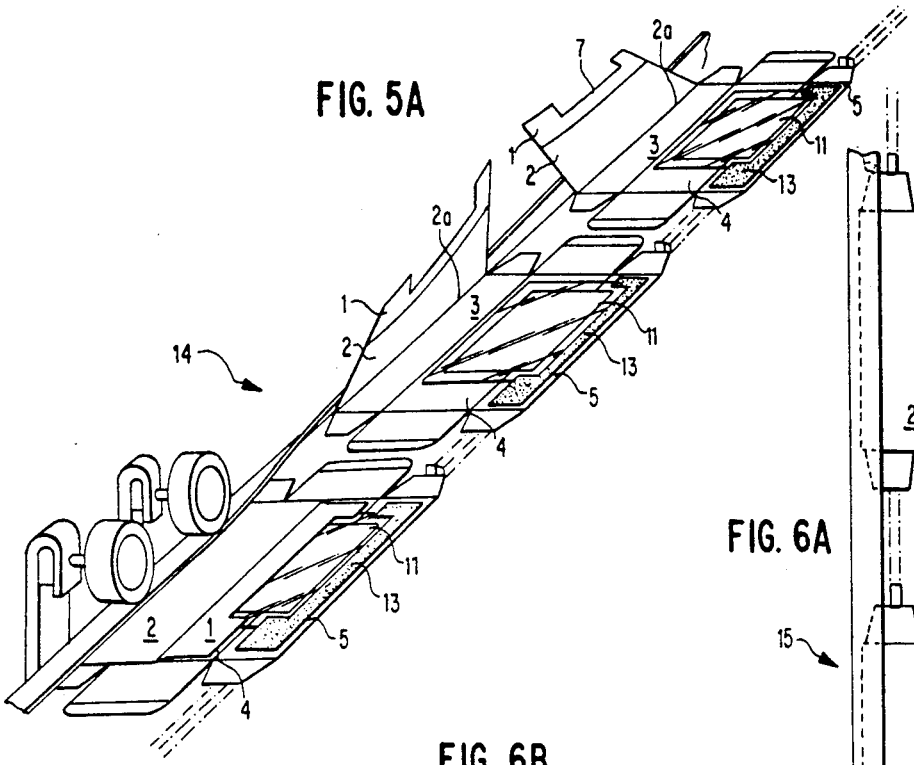
FIG. 5A is a schematic fragmentary perspective view of the apparatus for folding the blank to the position shown in FIG. 5.
Figure 6A:
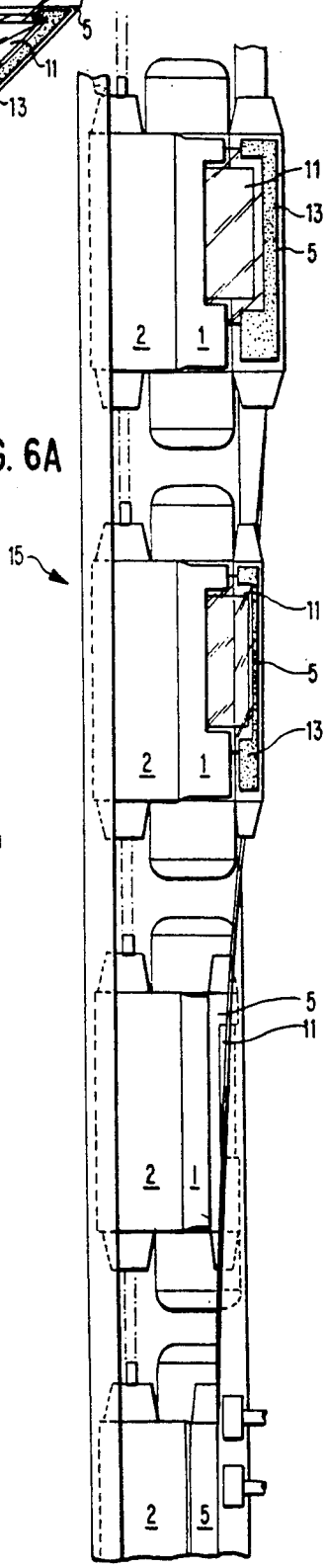
FIG. 6A is a schematic fragmentary top plan view showing the apparatus for folding the blank to the position of FIG. 6.

The blank shown in FIG. 4 is then conveyed further downstream to a folding station 14, as shown in FIG. 5A, wherein panels 1 and 2 are folded inwardly as a unit, on hinge or fold line **2*a*, to overlie the panels 3 and 4, as shown in FIG. 5. By this time the strip of adhesive 9 has set so there can be no slippage between window 11 and panel 4 to which it is secured. Further conveying of the thus folded blank downstream to another folding station 15, as shown in FIG. 6A, results in the panel 5 being folded inwardly on hinge line 4*a* to overlie panel 1, as shown in FIG. 6. The notched portion 8 of panel 5 thus overlies the notched edge 7 of panel 1, in substantial registration, with window 11** interposed therebetween.

Figure 6B:
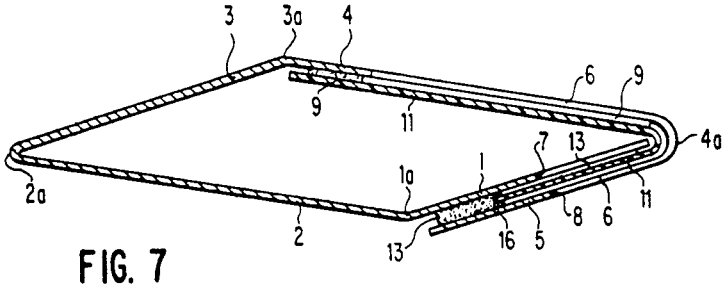
FIG. 6B is a view taken substantially along line 6B—6B of FIG. 6.
Figure 7:
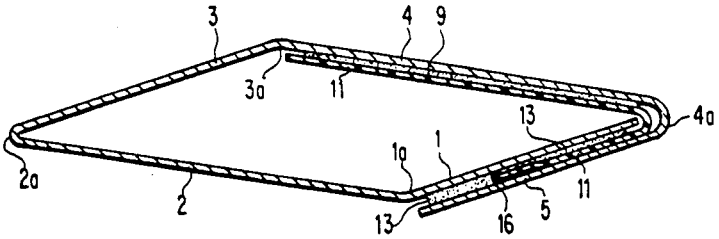
FIG. 7 is a view taken substantially along line 7—7 of FIG. 6.

During the folding of the panel 5 to overlie the panel 1, since there is no adhesive underneath the portion of the window 11 extending over the panel 5, and since the strip of adhesive 13 is still in a liquid state, the corresponding portion of the window 11, that is in the free end of window 11, is allowed to slip on the surface of the panel 5, whereby excess material of the window at the fold line **4*a* is free from confinement by the window frame, to thereby prevent distortion or fracture of the window 11 during the folding thereof. During the slippage of the free end of window 11 in the folding operation, the free longitudinal marginal edge of the window moves over top of the adhesive 13 on the adjacent surface of panel 5, so that a portion of the adhesive 13 flows underneath the longitudinally extending marginal portion of the window as at 16 as shown in FIGS. 6B and 7, while the remainder of the adhesive strip 13 secures the panel 5, on top of to panel 1. By this construction and arrangement, the strip of adhesive 13 employed for securing panels 1 and 5 together is also used for securing a portion of the window 11 in place, whereby the window 11 is secured to the blank by the strip of adhesive 9 and part of the longitudinally extending portion of the adhesive strip 13** that is adjacent the longitudinal marginal edge of the window.

Figure 8:
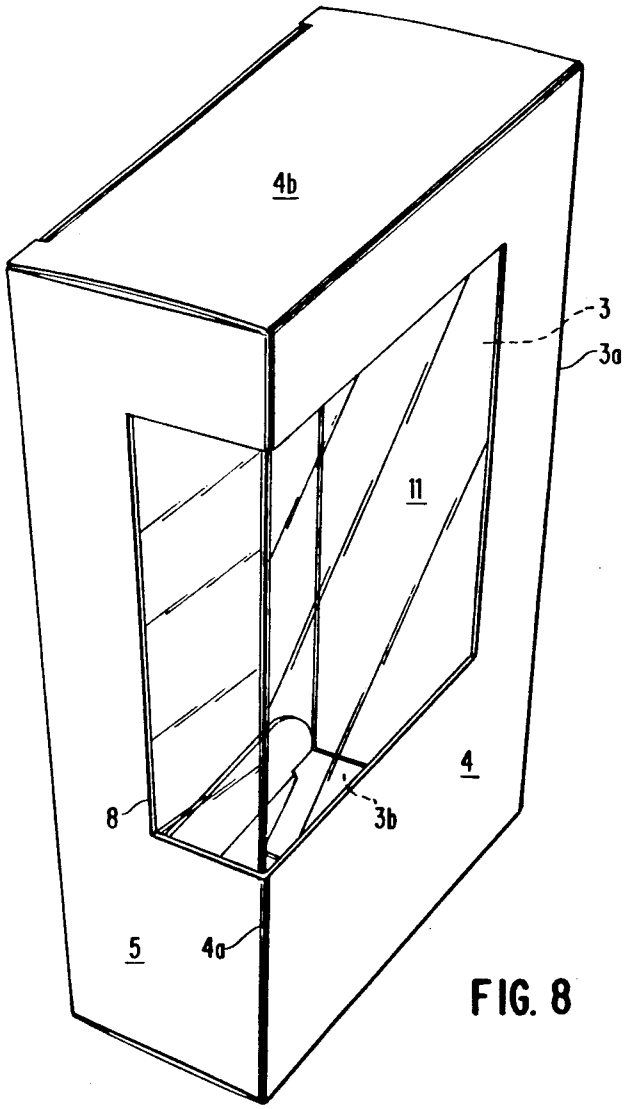
FIG. 8 is a perspective view of the display carton of the present invention in a fully erected position.

To complete the construction of the display carton of the present invention, the folded and adhered blank as shown in FIGS. 6, 6B and 7 are manipulated on hinge lines **1*a*, 2*a*, 3*a* and 4*a* to a rectangular cross-sectional configuration and the end flaps 3*b*, 4*b*, and 5*b* are folded inwardly and tucked together in a conventional manner to form a display container having a corner window as shown in FIG. 8**.

From the above description it will be readily apparent to those skilled in the art that the display carton of the present invention is an improvement over the prior art window display cartons in that the cardboard blank including the notched panel 1, window aperture 6 extending between adjacent panels 4 and 5, adhesive strip 9, window 11 and adhesive strip 13 is constructed and arranged to permit slippage of the window 11 during the folding of the blank but employing a portion of the adhesive strip 13 to bond the window 11 to the portion of the panel 5 adjacent the window so that the adhesive 13 which is employed for securing the overlapping panels 1 and 5 is also used for securing the window in place. The lateral edges of window 11 between hinge line **4*a* and the longitudinal marginal edge of window 11 that is secured by adhesive 13 to panel 5, are not secured by the adhesive to panel 5. They are sandwiched between the adhesively secured panels 5 and 1, and are also secured by adhesive 13 to panel 1 at opposite ends of notch 7**.

Furthermore, the notched panel 1 is dimensioned to correspond to the notched panel 5 so that when the blank is folded, the notch 7 in the edge of panel 1 is placed in aligned face-to-face relationship with the notch 8 in panel 5, to thereby form a portion of the window aperture on one side of the carton that is at substantially right angles to the portion of the window aperture on the adjacent panel 4.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A display carton having a corner window comprising a blank, cut, scored and folded to provide a plurality of hingedly connected side panels and end flaps, a rectangular window aperture extending between a pair of adjacent panels, a transparent plastic window extending over said window aperture and portions of the pair of adjacent panels adjacent to the aperture, the portion of the window extending over the portion of the panel adjacent the aperture in one panel being adhesively secured thereto, one of the plurality of panels being adhesively secured to the other panel of said pair of adjacent panels, a portion of the adhesive employed for securing said one of the plurality of panels to said other panel of said pair of adjacent panels also being used for adhesively securing a portion of the window to a portion of said other panel of said pair of adjacent panels.

2. A display carton according to claim 1, wherein one of the plurality of panels is notched on a free edge thereof, and dimensioned to correspond to said other panel of said pair of adjacent panels whereby the notched panel is aligned in face-to-face underlying relationship with the other panel of said pair of adjacent panels to thereby form a portion of the window aperture frame.

3. A display carton according to claim 1, in which first adhesive means extends adjacent to the aperture around three sides of said window aperture in said one panel to adhesively secure the portion of the window extending over the portion of the panel adjacent the aperture in said one panel.

4. A display carton according to claim 3, in which second adhesive means adhesively secures said one of the plurality of panels to the other panel of said pair of adjacent panels, said window having three marginal edge surface portions overlying said other panel of said pair of adjacent panels, said second adhesive means extending over said three marginal edge surface portions of said window and extending on a surface portion of said other panel adjacent said three marginal edge surface portions of said window.

5. A display carton according to claim 4, including non-adhesive zones on said pair of adjacent panels adjacent said window aperture and between said first adhesive means and said second adhesive means.

6. A display carton according to claim 4, in which said window having a free longitudinal marginal edge portion included in said three marginal edge surface portions, said portion of the adhesive employed for securing said one of the plurality of panels to said other panel of said pair of adjacent panels comprising said second adhesive means, and of said three marginal edge surface portions of said window said second adhesive means extending only between said free longitudinal marginal edge portion of said window and said other panel.

7. A method of making a display carton having a corner window comprising the steps of a) cutting and scoring a blank to provide a plurality of hingedly connected side panels and end flaps;
b) cutting the blank to form a window aperture extending between a pair of adjacent panels;
c) applying a first adhesive to a portion of one panel of said pair of adjacent panels on the marginal edge of said window aperture;
d) positioning a transparent window over said window aperture;
e) bonding a marginal edge portion of said window to said marginal edge of said window aperture by said first adhesive;
f) simultaneously applying a second adhesive to the top surface of the marginal edge of said window extending over the marginal edge of said window aperture in the other panel of said adjacent pair of panels, and to the surface of said other panel adjacent said marginal edge of said window;
g) folding the other panel of said adjacent pair of panels in face-to-face relationship with one of the plurality of hingedly connected panels to thereby form a portion of the window frame in said other panel of said adjacent panels;
h) allowing the marginal edge of said window to slip relative to the other panel of said adjacent pair of panels during the folding thereof and simultaneously over said second adhesive on said other panel adjacent said marginal edge of said window to bond the marginal edge of said window to said other panel;
i) bonding said other panel of said adjacent pair of panels to said one of the plurality of hingedly connected panels by said second adhesive;
j) manipulating the folded and adhered blank to a rectangular configuration; and
k) folding and tucking the end flaps to close the carton.

8. A method of making a display carton according to claim 7, wherein said one of the plurality of hingedly connected panels is cut to form a notch on a free edge thereof, and the notch is dimensioned to conform to the other panel of said adjacent panels.

9. A method of making a display carton according to claim 7, in which said folding, slipping and bonding steps g), h) and i) are performed substantially simultaneously.

10. A method of making a display carton according to claim 8, in which in the bonding step i) said other panel of said adjacent pair of panels is bonded by said second adhesive in overlying relation to said notched one panel of the plurality of hingedly connected panels.

* * * * *